US005992839A

United States Patent [19]

Kosasa

[11] Patent Number: 5,992,839

[45] **Date of Patent: *Nov. 30, 1999**

[54] SHEET STACKING APPARATUS

[75] Inventor: Hideaki Kosasa, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/636,500

[22] Filed: Apr. 23, 1996

[30] Foreign Application Priority Data

Apr. 28, 1995 [JP] Japan ..... 7-106693

[51] Int. Cl.[6] ..... B65H 39/02

[52] U.S. Cl. ..... 270/58.12; 270/58.27

[58] Field of Search ..... 270/58.01, 58.07, 270/58.08, 58.09, 58.11, 58.12, 58.27; 355/324; 412/33, 36, 37

[56] References Cited

U.S. PATENT DOCUMENTS 5,320,336 6/1994 Asami ..... 270/58.08

5,443,249 8/1995 Rizzolo et al. ..... 270/58.08

OTHER PUBLICATIONS

U.S. application No. 08/281,661, Yoshimasu et al., filed Jul. 28, 1994.

U.S. application No. 08/278,261, Yoshimasu et al., filed Jul. 21, 1994.

U.S. application No. 08/278,265, Hiroshi et al., filed Jul. 21, 1994.

U.S. application No. 08/278,280, Hideaki et al., filed Jul. 21, 1994.

*Primary Examiner*—Hoang Nguyen

*Attorney, Agent, or Firm*—Fitzpatrick, Cella, Harper & Scinto

[57] ABSTRACT

The present invention provides a sheet aligning apparatus which comprises a containing tray for containing sheets, a sheet storing device disposed above a sheet bundle contained in the containing tray and revolved between a first position to store the sheets in the sheet storing device and a second position to shift the stored sheets to the containing tray by the sheet storing device, and a posture maintaining device for rotating the sheet storing device when the sheet storing device is revolved, so that a posture of the sheet storing device in the first position becomes substantially the same as that in the second position.

24 Claims, 17 Drawing Sheets

SHEET STACKING APPARATUS

BACKGROUND OF THE INVENTION

1. Field of the Invention

The present invention relates to a sheet aligning apparatus for aligning sheets, and more particularly, it relates to a sheet aligning apparatus for aligning stacked sheets to form an aligned sheet bundle to be conveyed to a bookbinding apparatus, and a bookbinding apparatus having such a sheet aligning apparatus.

2. Related Background Art

In the past, a plurality of sheet aligning apparatuses were provided so that sheets are introduced into one of the sheet aligning apparatus while a sheet bundle is being discharged from the other sheet aligning apparatus. In this way, by using the sheet aligning apparatuses alternately, the continuous sheet supply was permitted.

Further, as shown in FIGS. 18A and 18B, there has been proposed a sheet aligning apparatus having stop fingers 305 acting as a temporary shorting means. In this aligning apparatus, each of the stop fingers 305 is formed from a plate member having an L-shaped cross-section and includes a sheet abutment portion 305*a* and a bottom portion or sheet dip portion 305*b*. Further, each stop finger is fixedly mounted on a drive shaft 305*c* so that the stop finger can selectively be shifted between a storing position where a sheet is guided to the dip portion 305*b* to abut the sheet against the abutment portion 305*a* and a retract position where the dip portion is spaced apart from a sheet convey surface. In addition, the stop fingers can be rotated from the storing position in an anti-clockwise direction to discharge the sheets stored on the stop fingers 305 onto a containing tray.

Incidentally, in FIGS. 18A and 18B, the reference numeral 306 denotes a paddle (sheet aligning means which can be rotated to afford an advancing force to the sheet, thereby aligning the sheet in a sheet conveying direction; 307 denotes an aligning means for aligning the sheets (sheet bundle) in a width-wise direction of the sheet and having a fixed reference plate 307*a* and a movable plate 307*b* shiftable in directions shown by the double-headed arrow to align the sheets; 309*a* and 309*b* denote sheet tip end abutment members shiftable between a protruded position where a tip end of the sheet abuts against the abutment members and a retract position where the sheet or the sheet bundle is not prevented from being conveyed from the containing tray; 310 denotes the above-mentioned containing tray; 311*a*, 311*b* and 311*c* denote inlet sheet upper guides; 313 denotes an inlet sheet lower guide; and 339 denotes a pair of convey rollers for conveying the sheet or the sheet bundle into the aligning apparatus.

The sheets successively conveyed into the aligning apparatus by means of the pair of convey rollers 339 are supplied onto the containing tray 310 while being guided by the inlet sheet upper guides 311*a*, 311*b*, 311*c* and the inlet sheet lower guide 313 in the vicinity of a sheet inlet, and then are urged against the fixed reference plate 307*a* and the tip end abutment members 309*a*, 309*b* by the movements of the sheet aligning means 306 and the movable plate 307*b* of the aligning means 307, thereby aligning the sheets.

The sheet bundle aligned by the sheet aligning apparatus is conveyed, by the convey means, from the containing tray 310 to a sheet post-treatment means for performing post-treatment (for example, stapling). In this case, the tip end abutment members 309*a*, 309*b* are shifted to the retract position so as not to interfere with the conveyance of the sheet bundle, and tip ends of the dip portions 305 of the stop fingers 305 are urged against an upper surface of the sheet bundle to be conveyed. In this condition, the next sheets (for a next sheet bundle) conveyed from the pair of convey rollers 339 are guided by the dip portions 305*b* of the stop fingers 305 and are urged against the abutment portions 305*a*, thereby storing the next sheets. After the previously aligned sheet bundle was conveyed by the convey means, the tip end abutment members 309*a*, 309*b* are returned to the protruded position, and, at the same time, the stop fingers 305 are rotated in the anti-clockwise direction by the drive shaft 305*c*, thereby dropping the next sheet bundle temporarily stored on the stop fingers 305 onto the containing tray 310.

However, in the above-mentioned conventional technique, after the sheets are stored temporarily by the stop fingers 305, when the sheets are transferred to the containing tray 310 by the rotation of the stop fingers 305, since the sheets are freely dropped from the stop fingers 305, if any air enters between the sheets during the dropping of the sheets onto the containing tray, the aligned sheets may be disordered. Although the disorder of an uppermost sheet can be corrected by abutting the uppermost sheet against the tip end abutment members 309*a*, 309*b* by the rotation of the aligning paddle 306 and the lateral disorder of the sheet bundle can be corrected by abutting the sheet bundle against the fixed reference plate 307*a* by the movement of the movable plate 307*b*, the other disordered conditions cannot be corrected in the above-mentioned sheet aligning apparatus. Thus, if the sheet bundle is conveyed to the stapling means (post-treatment means) in the disordered condition, the poor bookbinding will occur.

Further, since the stop fingers 305 are rotated around the drive shaft 305*c*, in dependence upon a thickness of a single sheet bundle, an angle between the top surface of the sheet bundle and the dip portions 305*b* of the stop fingers 305 is varied, with the result that a gap is created between the dip portions 305*b* and the sheet bundle, which may lead to incorrect storing of the next sheets. To avoid this, it is considered that various kinds of stop fingers are prepared and the stop fingers are changed in accordance with the thickness of the sheet bundle. However, in this method, the operation for replacing the stop fingers is troublesome, and since various kinds of stop fingers must always be prepared, the entire apparatus is made to be more expensive.

SUMMARY OF THE INVENTION

An object of the present invention is to provide a sheet aligning apparatus and a bookbinding apparatus having such a sheet aligning apparatus, in which, when a sheet bundle rested on a containing tray is conveyed to a bookbinding apparatus, for example, the sheet bundle can be conveyed to the bookbinding apparatus while maintaining an aligned condition of the sheet bundle.

To achieve the above object, according to the present invention, there is provided a sheet aligning apparatus comprising a containing tray for containing sheets, a sheet storing means disposed above a sheet bundle contained in the containing tray and movable between a first position where sheets are stored in the sheet storing means and a second position where the stored sheets are transferred onto the containing tray by the sheet storing means, and a posture maintaining means for shifting the sheet storing means when the sheet storing means is moved, so that a posture of the sheet storing means in the first position becomes substantially the same as that in the second position.

The present invention further provides a sheet aligning apparatus comprising a containing tray for containing sheets, a sheet storing means disposed above a sheet bundle contained in the containing tray and revolved between a first position where sheets are stored in the sheet storing means and a second position where the stored sheets are transferred onto the containing tray by the sheet storing means, and a posture maintaining means for rotating the sheet storing means when the sheet storing means is revolved, so that a posture of the sheet storing means in the first position becomes substantially the same as that in the second position.

With the arrangement as mentioned above, when the sheet storing means is positioned at the first position above the sheet bundle rested on the containing tray, the next sheets are stored in the sheet storing means. Then, an end abutment means provided on the containing tray is shifted to a retract position and an aligned sheet bundle convey means grips or pinches the sheet bundle rested on the containing tray and conveys the sheet bundle from the containing tray. Then, the sheet storing means storing the next sheets thereon is lowered to the second position nearer the containing tray while keeping its posture constant, and, then, the next sheets stored on the sheet storing means are transferred onto the containing tray. Thereafter, the sheet storing means is lifted to the first position, where further sheets are stored on the sheet storing means.

Accordingly, since the sheet storing means has its posture at the first position substantially the same as that at the second position, even when the sheet bundle stored on the sheet storing means in a non-stapled condition is transferred onto the containing tray, the sheet bundle is still maintained in the aligned condition. Thus, when the sheet bundle on the containing tray is conveyed to the bookbinding apparatus by the aligned sheet convey means, the sheet bundle can be stapled in the aligned condition.

As mentioned above, in the sheet aligning apparatus according to the present invention, when the sheet bundle stored on the sheet storing means is transferred from the first position (waiting position) above the containing tray onto the containing tray, since the sheet storing means is moved while keeping its posture constant, the sheet bundle is rested on the containing tray in the aligned condition. Accordingly, when the sheet bundle is book-bound, since the sheet bundle is stapled in the align ed condition, the bookbinding ability can be improved.

Further, by aligning the sheets stored on the sheet storing means by means of the sheet aligning means, since the sheet bundle is stapled in the aligned condition, the bookbinding ability can be further improved.

In addition, by forming the sheet storing means from a plate member having an L-shaped cross-section and by forming a bottom portion of the sheet storing means from elastic material, when the sheet storing means is positioned at the first position where the sheets are stored, an imaged surface of an uppermost sheet on the sheet bundle can be prevented from being damaged. Further, by providing a sheet thickness detection means for detecting a thickness of the sheet or the sheet bundle in the vicinity of a tip end of the containing tray and by controlling the first position (where the sheets to be introduced to the containing tray are stored temporarily) on the basis of a detection result from the sheet thickness detection means, the succeeding sheets can be stored on the sheet storing means more positively.

Furthermore, by constituting a sheet discharge means by a roller movable between a second position where the sheet on the containing tray is conveyed by the roller and a first position where the roller does not interfere with the transferring of the sheet bundle to the containing tray and aligning the sheet bundle and by conveying the sheets successively from an uppermost one by the roller, it is possible to prevent the contamination of the sheet inherent to the lowermost sheet separation/supply mechanisms. And, by using the sheet aligning apparatus according to the present invention with a bookbinding apparatus (as a sheet post-treatment apparatus), since the sheet bundle which is aligned with high accuracy can be stapled, a high quality book-bound article can be obtained.

DESCRIPTION OF THE PREFERRED EMBODIMENTS

The present invention will now be explained with reference to the accompanying drawings.

Figure 1:
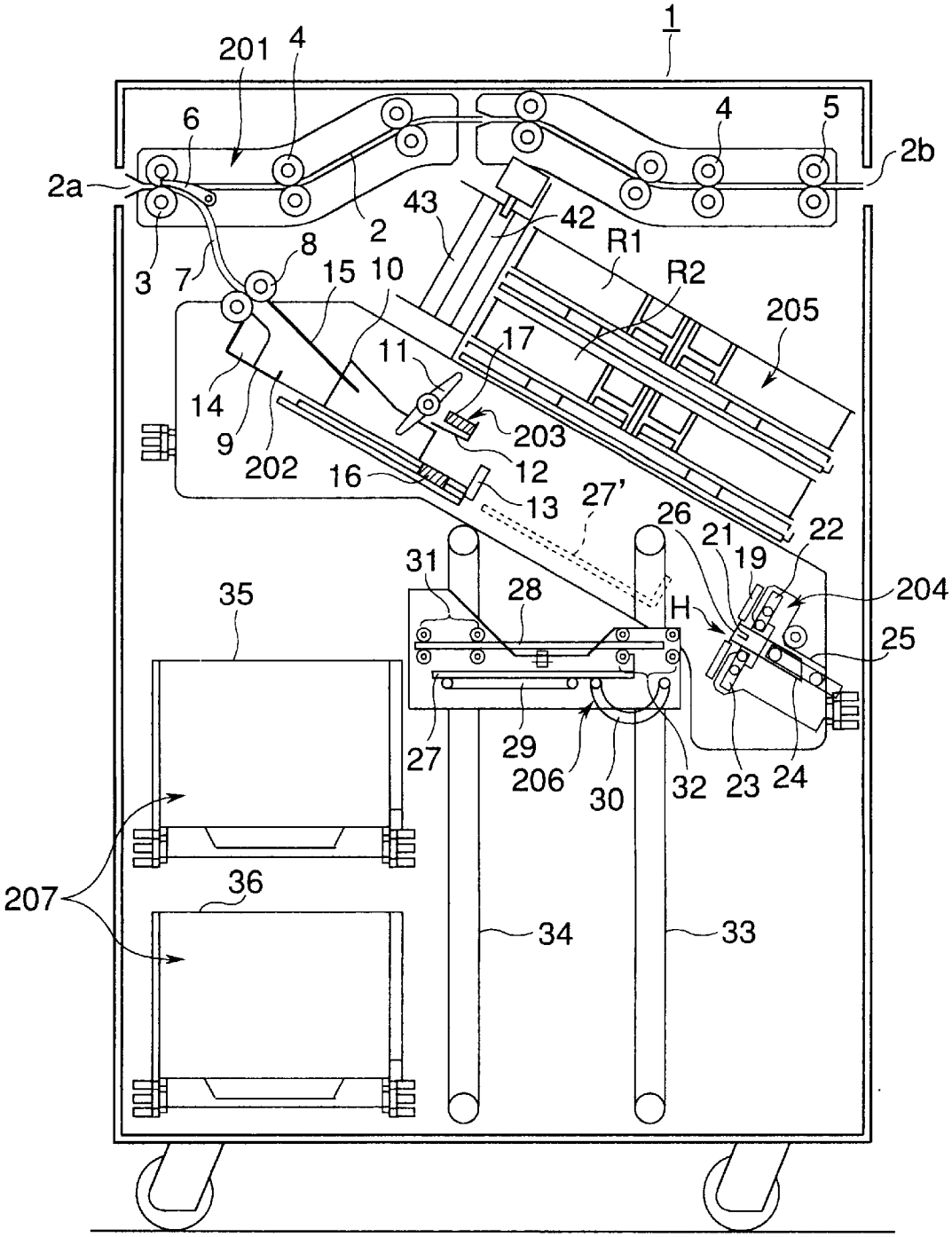
FIG. 1 is an elevational sectional view of the entire bookbinding apparatus according to the present invention.

A bookbinding apparatus 1 is constituted by a sheet conveying apparatus 201, a sheet aligning 202, a sheet bundle conveying apparatus 203, a tape heating apparatus 204, a tape conveying apparatus 205, a book-bound sheet bundle conveying apparatus 206 and a containing stacker 207 (FIG. 1).

The sheet conveying apparatus 201 includes a convey path 2 for a sheet S to be conveyed, which a convey path has a convey inlet 2*a* and a convey outlet or discharge opening 2*b*. There are disposed a pair of convey-in rollers 3, a plurality of pairs of convey rollers 4 and a pair of discharge rollers 5 in the convey path 2 from upstream to downstream. A flapper (branch means) 6 is disposed at a downstream side of and in the vicinity of the pair of convey-in rollers 3 so that, when the sheets are book-bound, the convey path 2 is switched to a convey path 7 by the flapper 6.

Figure 2:
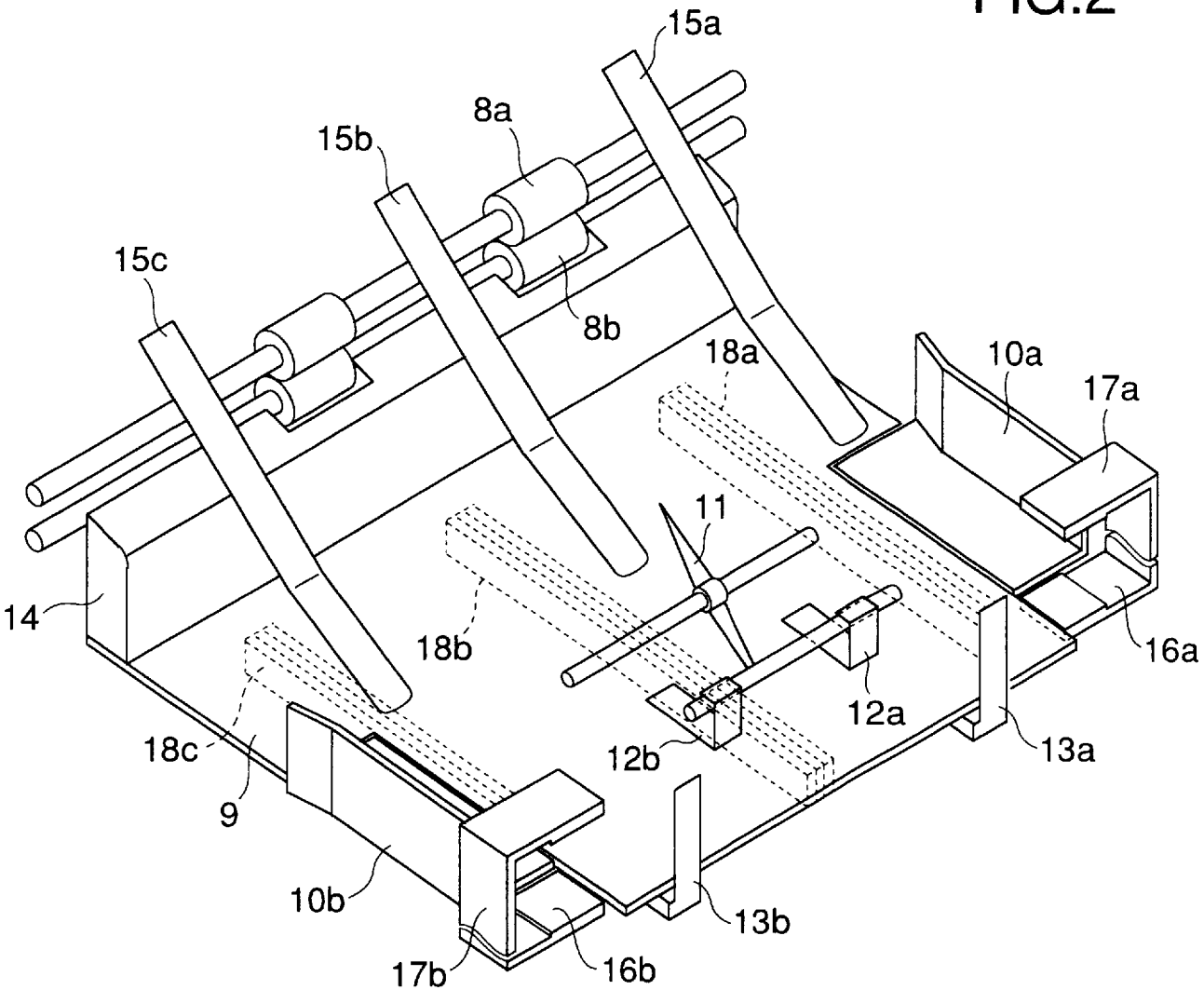
FIG. 2 is a perspective view of a sheet aligning apparatus.

The sheet S introduced into the convey path 7 by the flapper 6 is conveyed into the sheet aligning apparatus 202 by a pair of sheet convey rollers 8. The sheet aligning-apparatus 202 comprises a containing tray 9 for containing the sheets, an alignment fence 10 for aligning lateral edges (parallel with a sheet conveying direction) of the sheets, an alignment paddle 11 for aligning tip ends of the sheets, a stop finger means 12 comprised of L-shaped members for waiting or storing the sheets temporarily, a tip end reference shutter means 13 against which the tip end of the sheet abuts, an inlet lower guide 14 for guiding a lower surface of the sheet at an inlet of the apparatus, and an upper guide 15 for guiding an upper surface of the sheet at the inlet of the apparatus (FIGS. 1 and 2). A bottom surface portion (dip portion) 12" of the stop finger means 12 is constituted by an elastic material. The reference numeral 12' denotes a sheet abutment portion.

The sheet S enters into the sheet aligning apparatus 202 abuts against the tip end reference shutter 13 (constituted by shutter portions 13*a,* 13*b*) while an upper surface of the sheet is being guided by the inlet upper guide 15 (constituted by guide portions 15*a,* 15*b,* 15*c*) and a lower surface of the sheet is being guided by the inlet lower guide 14. In this case, the sheet is aligned by the alignment paddle 11 in the sheet conveying direction and by the alignment fence 10 in a direction transverse to the sheet conveying direction. The alignment fence 10 comprises a fixed fence portion 10*a* and a movable fence portion 10*b* so that the sheet is urged against the fixed fence portion 10*a* by the movable fence portion 10*b,* thereby aligning the sheet. When sheet bundles are continuously book-bound, the stop finger means 12 (constituted by stop finger portions 12*a,* 12*b*) is operated to cause a succeeding sheet bundle to wait temporarily until a preceding sheet bundle is conveyed out of the containing tray 9. Then, the stop finger means 12 is released, with the result that the succeeding sheet bundle is transferred onto the containing tray 9.

The sheet bundle conveying apparatus 203 comprises a movable grip plate 17 (constituted by plate portions 17*a,* 17*b*), a fixed grip plate 16, a grip drive mechanism (not-shown) for causing the gripping of the movable grip plate 17, a shift mechanism (not shown) for shifting the movable and fixed grip plates 17, 16, and a sheet bundle guide 18 (FIGS. 1 and 2).

Figure 3A:
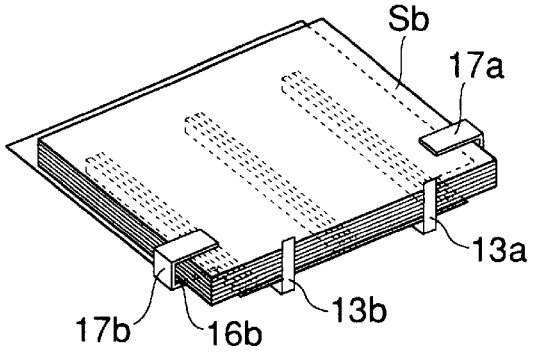
FIGS. 3A to 3C and FIGS. 4D to 4F are perspective views showing a condition that a sheet bundle is being conveyed.
Figure 3B:
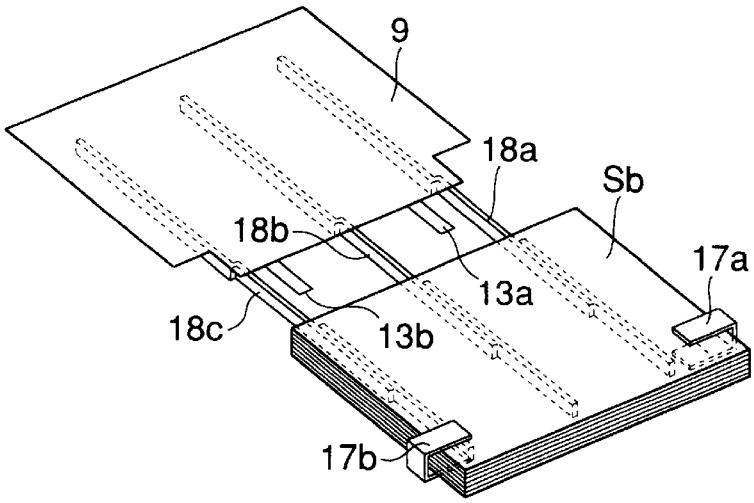

After the sheets are aligned in the sheet aligning apparatus 202, the grip drive mechanism (not shown) is operated to move the movable grip plate 17 toward the fixed grip plate 16 to pinch or grip the aligned sheet bundle therebetween (FIG. 3A). When the pinching of the sheet bundle is completed, the shift mechanism (not shown) is operated to shift the movable and fixed grip plates 17, 16, so that the aligned sheet bundle is conveyed from the sheet aligning apparatus 202 to the tape heating apparatus 204 while being pinched between the movable and fixed grip plates 17 and 16 (FIG. 3B). In this case, a lower surface of a trail end of the sheet bundle is supported by the sheet bundle guide 18 (constituted by guide portions 18*a,* 18*b,* 18*c*). (The sheet bundle guide 18 is shifted together with the movable and fixed grip plates 17, 16).

The tape heating apparatus 204 comprises tape guides 19, 20, a center heater 21, side heaters 22, 23, a drive mechanism 24 for the center heater 21, and a drive mechanism 25 for the side heaters 22, 23 (FIG. 1). Before the aligned sheet bundle is conveyed to the tape heating apparatus 204 by the sheet bundle conveying apparatus 203, a bind tape 26 is supplied to the tape guides 19, 20 of the tape heating apparatus 204 by the tape conveying apparatus 205.

Figure 5:
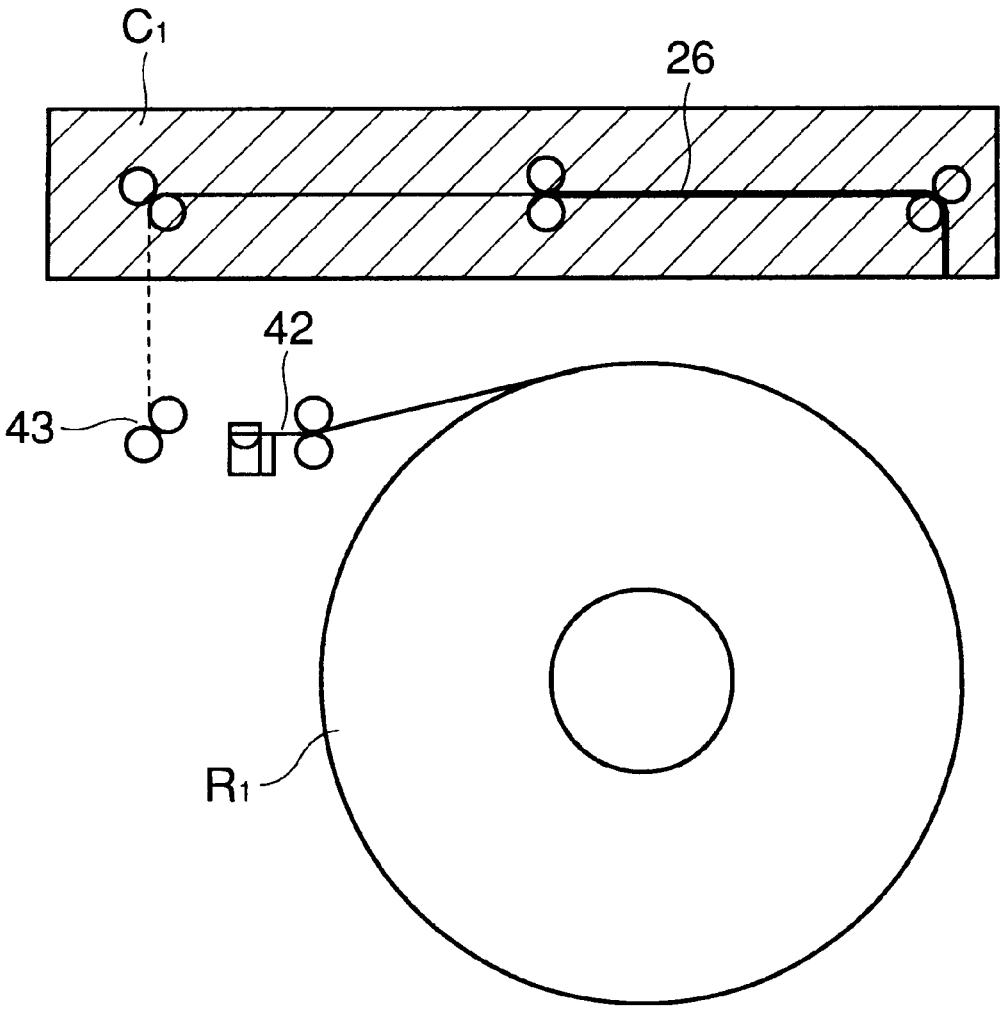
FIGS. 5 to 7 are sectional views showing a condition that a tape is cut in a tape convey apparatus.
Figure 6:
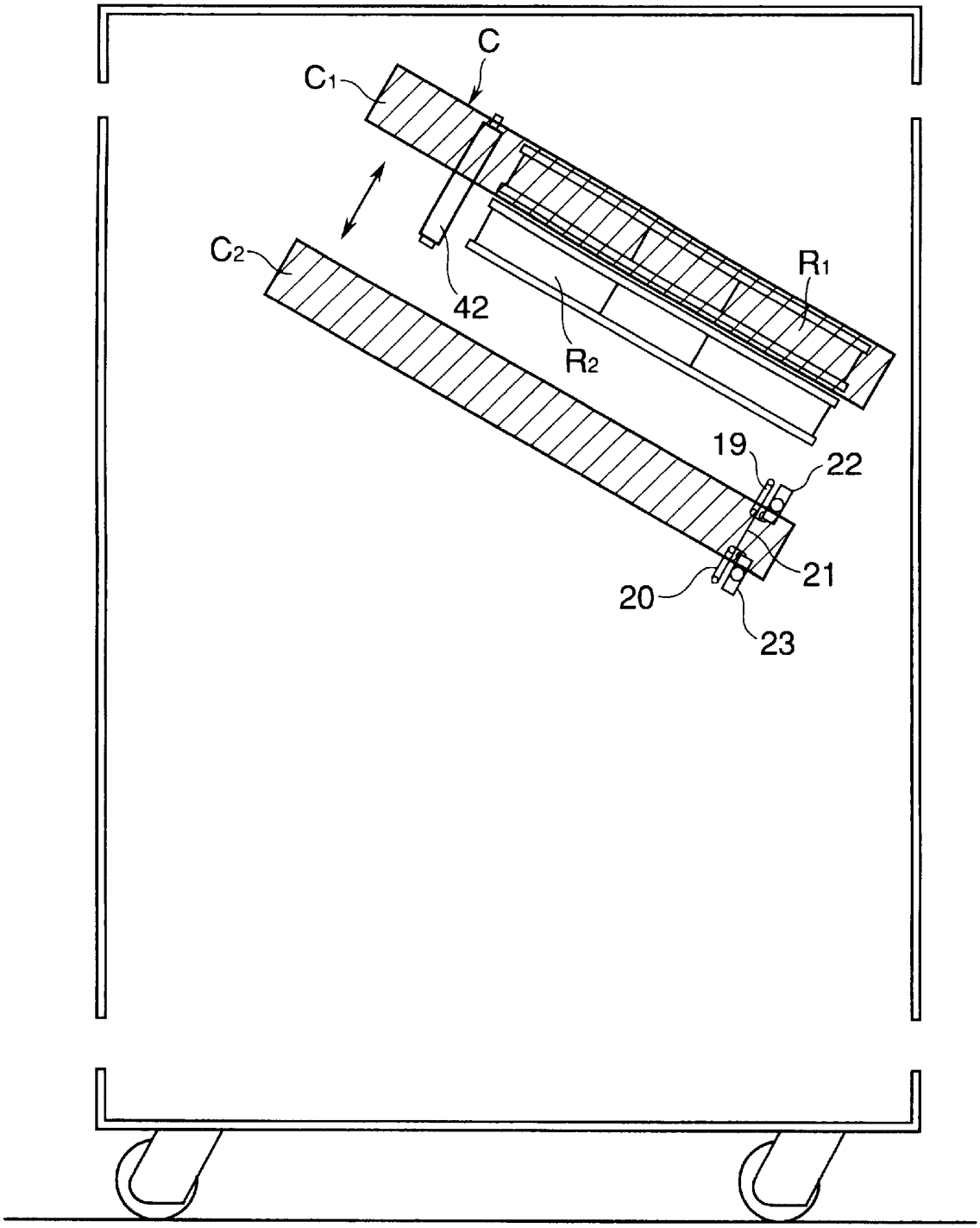

The tape conveying apparatus 205 comprises tape reels R1, R2, a carriage convey member C, a tape cutter 42, and tape convey means 43, 44 (FIG. 1). Tapes wound around the tape reels R1, R2 are cut by the tape cutter 42 to a predetermined length (to form the bind tape 26). The bind tape 26 is conveyed into the carriage convey member C by the tape convey means 43 (FIG. 5). When the bind tape 26 is conveyed into the carriage convey member C by the tape convey means 43, the carriage convey member C is shifted from a tape receiving position Cl to a tape sending position C2 (FIG. 6).

Figure 7:
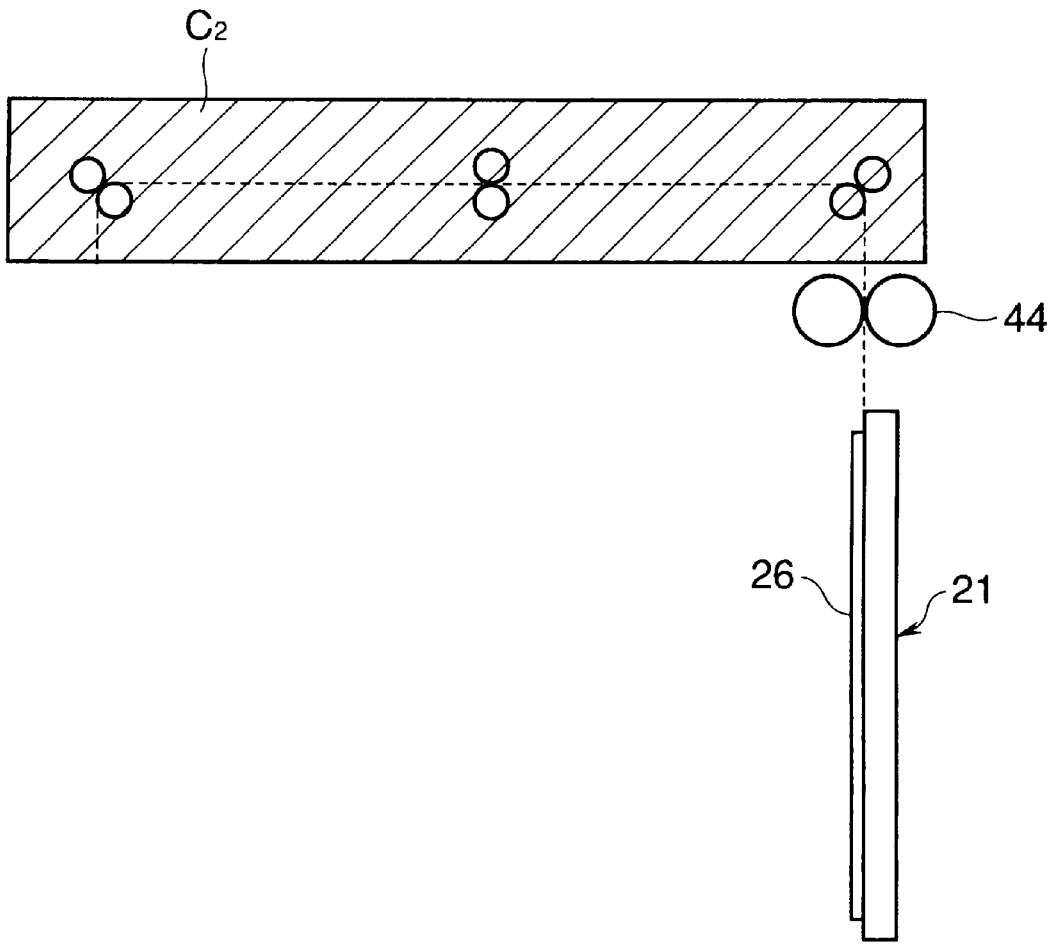

After the carriage convey member C was shifted from the tape receiving position C1 to the tape sending position C2, the bind tape 26 is supplied to the tape guides 19, 20 by the tape convey means 44 (FIG. 7).

Figure 3C:
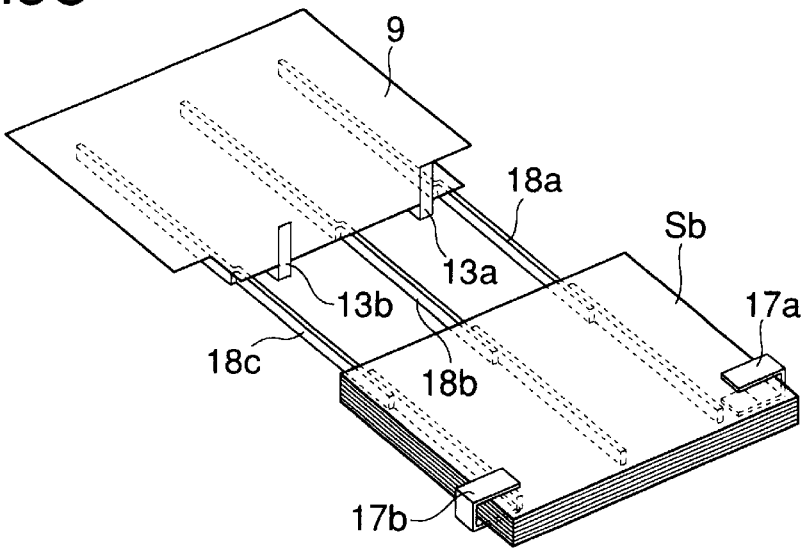

After the bind tape 26 was supplied, the center heater 21 is shifted from a retract position (not shown) to a heating position (FIG. 1) by the drive mechanism 24 to start the pre-heating of the bind tape 26. When the aligned sheet bundle is conveyed to a back surface abutment position H by the sheet bundle conveying apparatus 203 (FIG. 3C), a back surface of the sheet bundle is bound by the bind tape. When the binding of the back surface of the sheet bundle is completed, the side heaters 22, 23 are driven by the drive mechanism 25 so that the side heaters are shifted to lift both lateral edge portions of the bind tape 26 while retracting the tape guides 19, 20 to a retract position (not shown), with the result that the sheet bundle Sb is pinched between the moving side heaters 22, 23 with the interposition of the lateral edge portions of the bind tape, thereby performing the side binding of the sheet bundle.

Figure 4D:
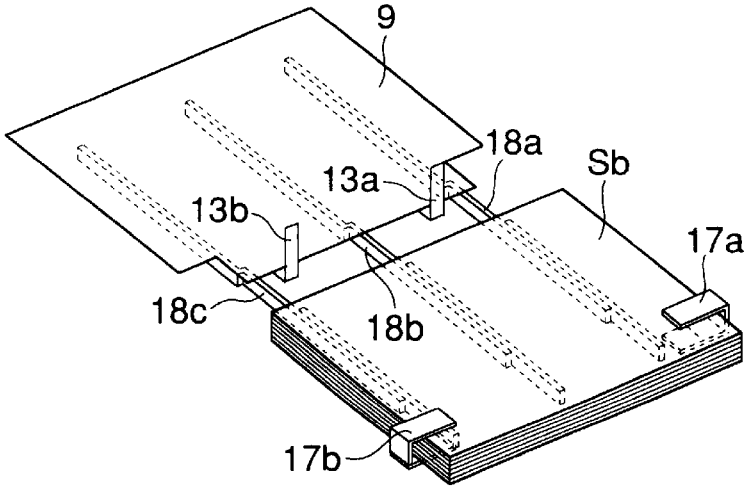

When the side binding of the sheet bundle is completed, the pressure of the side heaters 22, 23 (against the sheet bundle) is released. When the pressure of the side heaters 22, 23 is released, the book-bound article Sc is sent from the back surface abutment position H to a transfer position (to the book-bound sheet bundle conveying apparatus 206) by the sheet bundle conveying apparatus 203 (FIG. 4D).

The center heater 21 and the side heaters 22, 23 are returned to their retract positions by the drive mechanisms 24, 25, respectively, thereby permitting the supply of a next bind tape to the tape guides.

The book-bound sheet bundle conveying apparatus 206 comprises a book-bound article receiving tray 27, a book-bound article convey tray 28, a drive mechanism 29, 30 for the book-bound article receiving tray 27, a drive mechanism 31, 32 for the book-bound article convey tray 28, and a lift/lower means 33, 34.

Figure 4E:
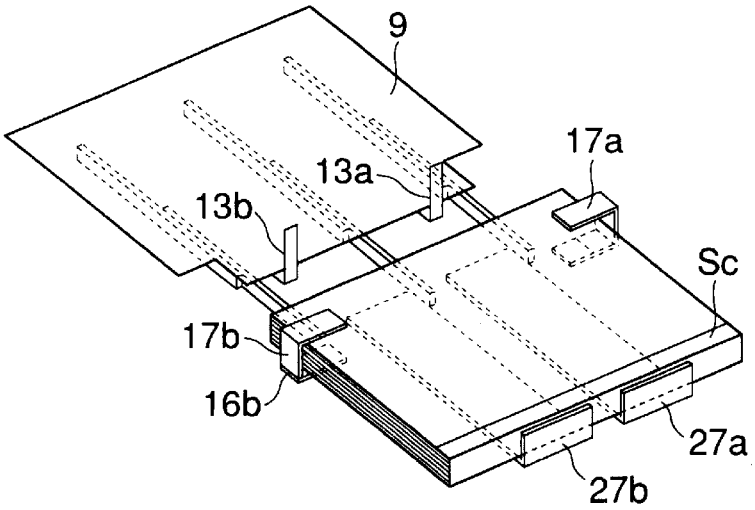

When the book-bound article Sc is sent from the back surface abutment position H to the transfer position (to the book-bound sheet bundle conveying apparatus 206) by the sheet bundle conveying apparatus 203, the receiving tray 27 is shifted to its book-bound article receiving position by the drive mechanism 29, 30. When the receiving tray 27 reaches the book-bound article receiving position, the gripping of the movable and fixed grip plates 17, 16 of the sheet bundle conveying apparatus 203 is released, with the result that the book-bound article Sc is transferred to the receiving tray 27. Then, the sheet bundle conveying apparatus 203 is returned to the sheet bundle gripping position associated with the sheet aligning apparatus 202 (FIG. 4E).

Figure 4F:
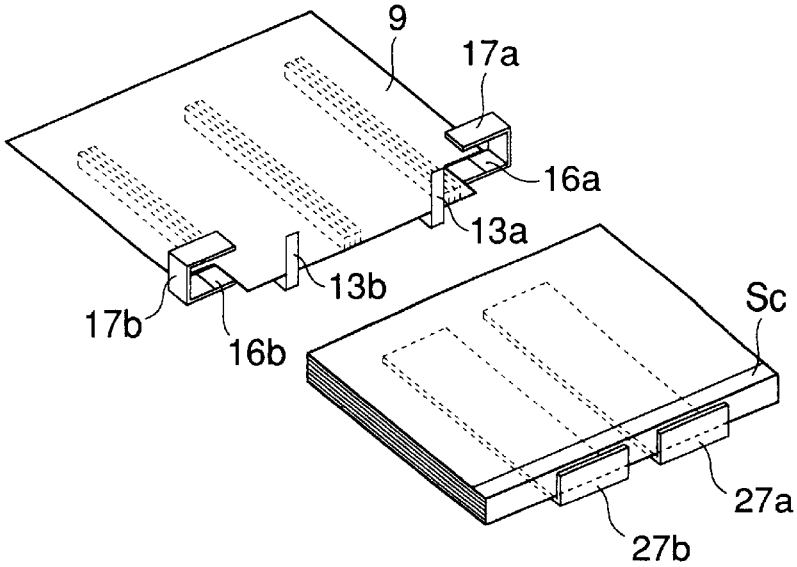

When the receiving tray 27 receives the book-bound article Sc (FIG. 4F), the receiving tray 27 is shifted to a transfer position T (to the book-bound article convey tray 28) by the drive mechanism 29, 30.

Figure 8A:
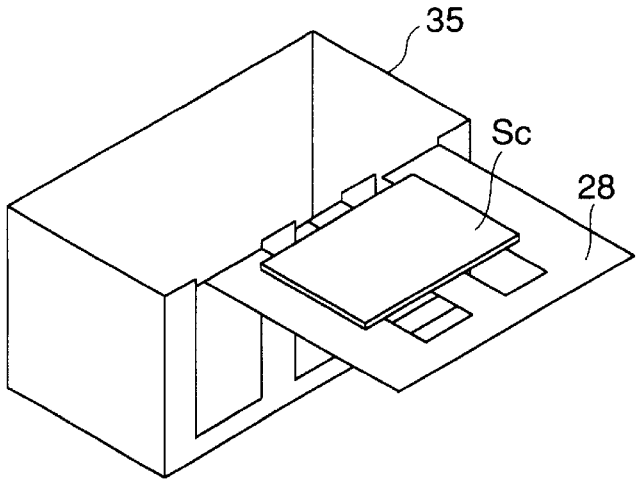
FIGS. 8A to 8C are perspective views showing a condition that a book-bound sheet bundle is being conveyed to a stacker.
Figure 8B:
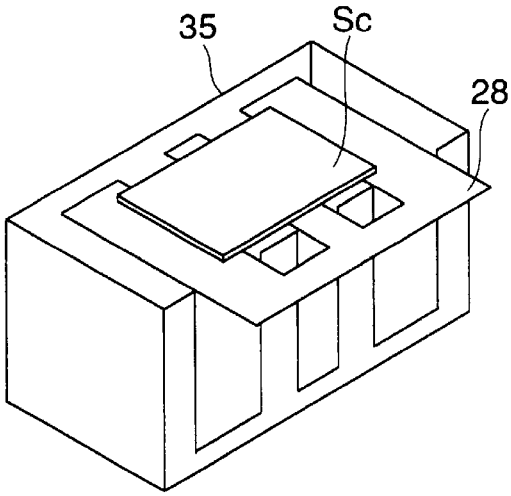
Figure 8C:
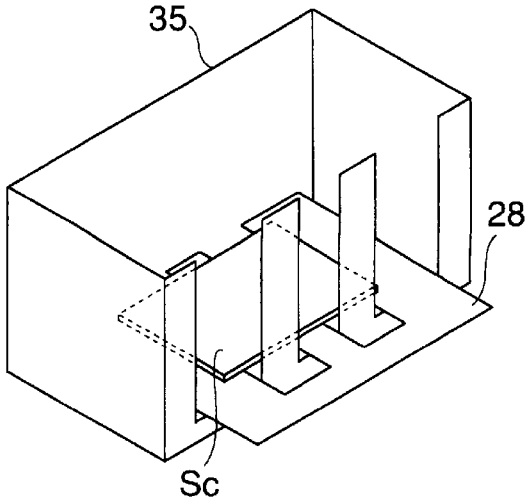
Figure 9A:
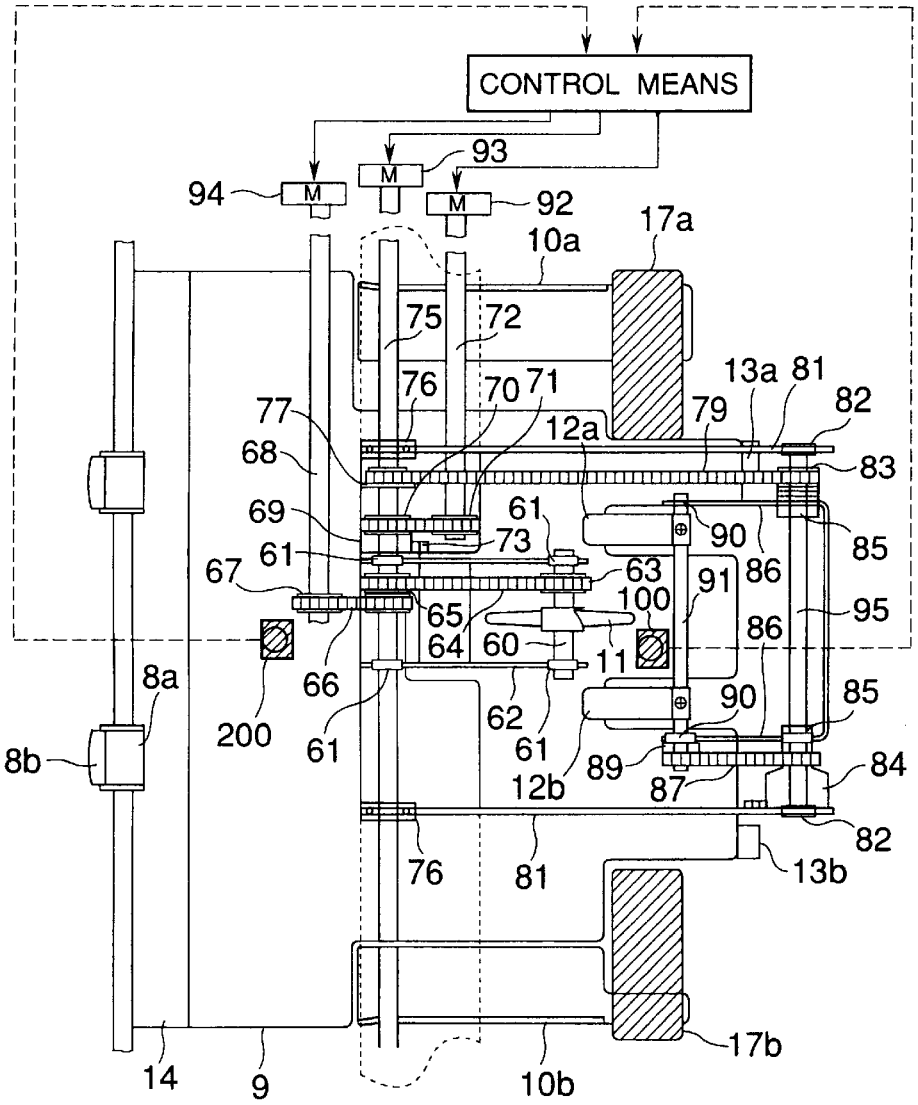
FIGS. 9A and 9B are views showing a control mechanism for driving an alignment paddle and a stop finger means.
Figure 9B:
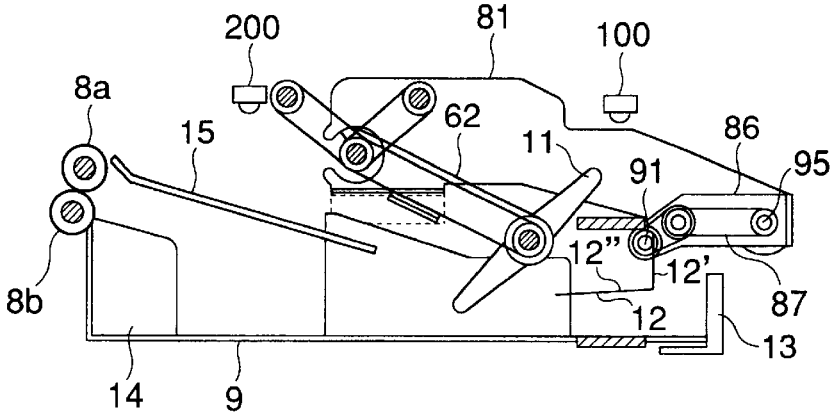
Figure 10A:
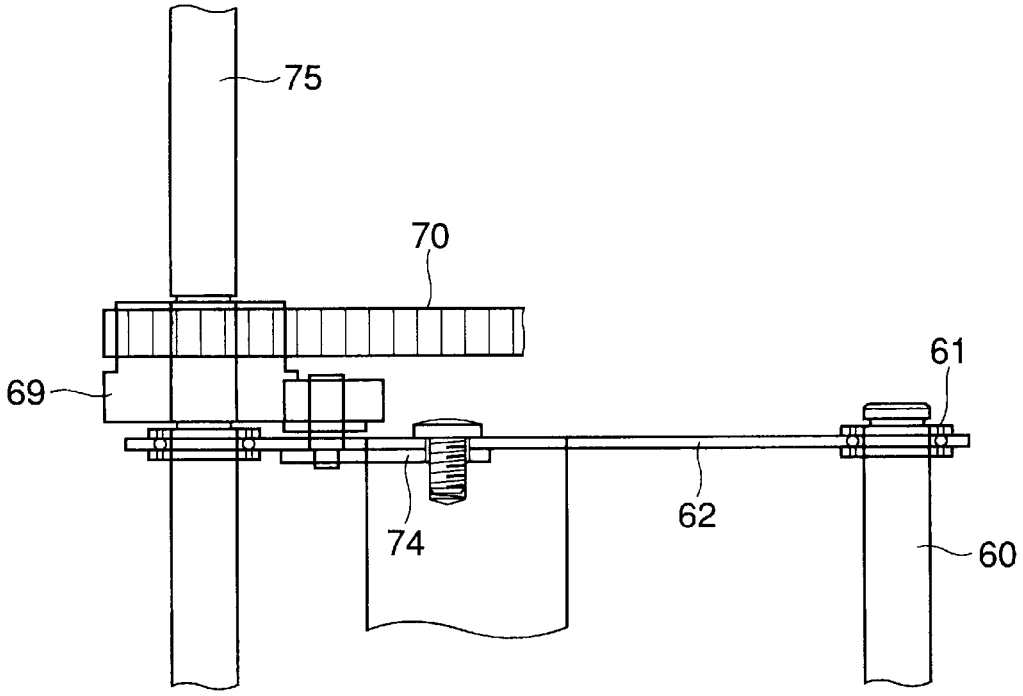
FIGS. 10A and 10B are enlarged views showing a portion of FIGS. 9A and 9B.
Figure 10B:
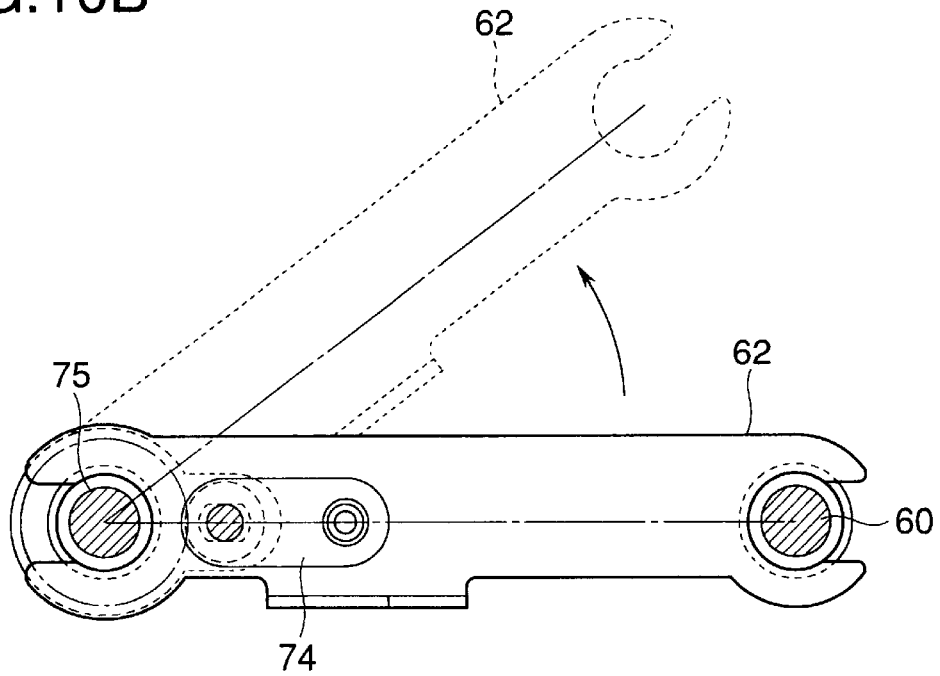

When the book-bound article convey tray 28 receives the book-bound article Sc at the transfer position T, the book-bound article convey tray is shifted above the containing stacker 35 by the drive means 31, 32 (FIGS. 8A and 8B). Then, the book-bound article Sc is lowered together with the convey tray 28 within the containing stacker 35 by the lift/lower means 33, 34 (FIGS. 8B and 8C). Then, by shifting the book-bound article convey tray 28 out of the containing stacker 35, the book-bound article Sc is contained within the containing stacker 35 (FIG. 8C).

Next, the control for the sheet temporarily storing means of the sheet aligning apparatus according to the present invention will be explained with reference to FIGS. 9A, 9B, 10A, 10B, 11A, 11B, 12C, 12D, 13E, 13F and 14G.

In FIGS. 9A, 9B, 10A and 10B, the reference numeral 60 denotes an alignment paddle shaft; 61 denotes bearings; 62 denotes paddle support plates pivotally supported on a shaft 75; 63 denotes a paddle drive pulley; 64 denotes a paddle drive belt; 65 denotes a paddle relay pulley; 66 denotes a paddle input belt; 67 denotes a paddle input pulley; 68 denotes a paddle input shaft; 69 denotes a paddle lift/lower drive pulley; 70 denotes a paddle lift/lower drive belt; 71 denotes a paddle lift/lower input pulley; 72 denotes a paddle lift/lower input pulley shaft; 73 denotes a paddle lift/lower support pin; 74 denotes a pin support plate (FIGS. 10A and 10B); 75 denotes the above-mentioned stop finger drive input shaft; 76 denotes bearings; 77 denotes a stop finger rotation input pulley; 79 denotes a stop finger rotation input belt; 81 denotes stop finger support plates; 82 denotes bearings; and 83 denotes a stop finger rotation drive pulley. A stop finger phasing relay pulley 84 is secured to one of the support plates 81. The pulley 84 is provided at its periphery with a toothed surface to form a gear.

The reference numeral 85 denotes stop finger rotation support plate bearings. Stop finger rotation support plates 86 are rotated integrally with a stop finger rotation support shaft 95. A stop finger phasing drive belt 87 which has teeth meshed with the gear of the pulley 84. A phasing drive pulley 89 is secured to a stop finger shaft 91 and is provided at its periphery with a toothed surface. The stop finger shaft 91 is rotatably supported by the rotation support plates 86 via bearings 90. The reference numeral 92 denotes an alignment paddle lift/lower motor; 93 denotes a stop finger drive motor; and 94 denotes an alignment paddle drive motor. The stop finger rotation support shaft 95 loosely extending through a center of the pulley 84 and is rotatably supported by the support plates 81. The reference numeral 100 denotes a tip end bundle thickness detection sensor (distance sensor); and 200 denotes a trail end bundle thickness detection sensor (distance sensor).

Next, an operation of the sheet temporarily storing means will be described with reference to FIGS. 11A, 11B, 12C, 12D, 13E, 13F and 14G.

Figure 11A:
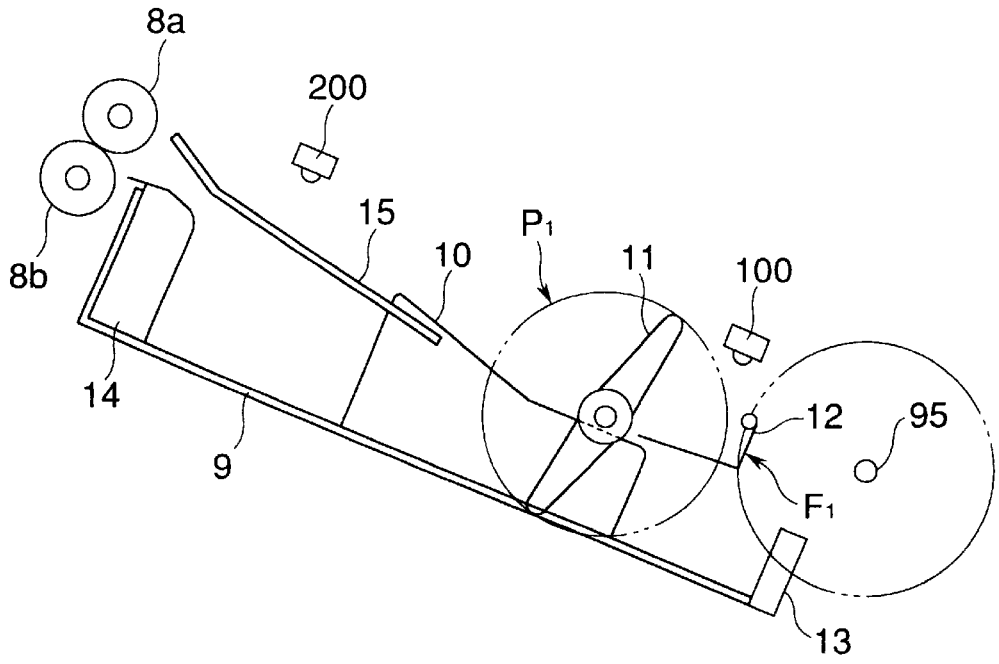
FIGS. 11A and 11B are sectional views showing a condition that sheets are being aligned.

When the sheets are received by the sheet aligning apparatus 202, a driving force of the alignment paddle drive motor 94 is transmitted to the alignment paddle shaft (supported by the puddle support plates 62 via the bearings 61) through the paddle input shaft 68, paddle input pulley 67, paddle input belt 66, paddle relay pulley 65, paddle drive belt 64 and paddle drive pulley 63, with the result that, as shown in FIG. 11A, the alignment paddle 11 secured to the alignment paddle shaft 60 is rotated at a predetermined number of revolutions in a position P1. On the other hand, the stop finger means 12 is waiting at a position F1.

Figure 11B:
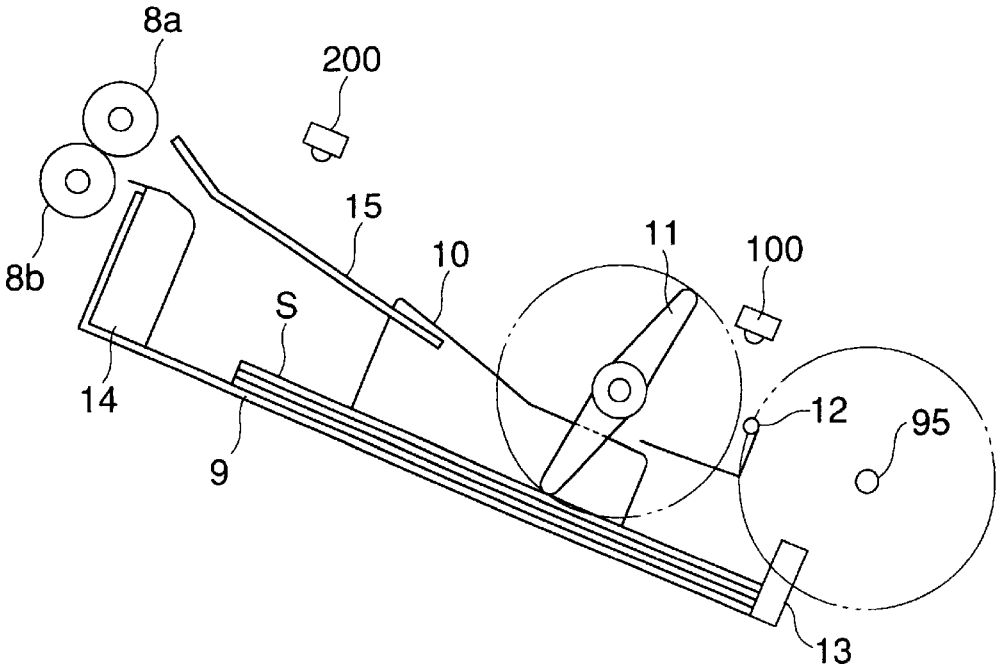

When the fact that a sheet bundle having a predetermined thickness is contained on the containing tray is detected by the tip end bundle thickness detection sensor 100, the alignment paddle lift/lower motor 92 is operated. A driving force of the motor 92 is transmitted to the paddle lift/lower drive pulley 69 through the paddle lift/lower input pulley shaft 72, paddle lift/lower input pulley 71 and paddle lift/lower drive belt 70, with the result that the paddle lift/lower drive pulley 69 causes the paddle lift/lower support pin 73 (secured to the paddle support plate 62 via the pin support plate 74) rotate in a direction shown by the arrow (FIG. 10B), thereby shifting the alignment paddle 11 upwardly by a predetermined amount, as shown in FIG. 11B. Whenever the fact that the thickness of the stacked sheets exceeds a predetermined value is detected by the tip end bundle thickness detection sensor 100, the alignment paddle lift/lower motor 92 is rotated by a predetermined amount, thereby lifting the alignment paddle 11 by the predetermined amount.

Figure 12C:
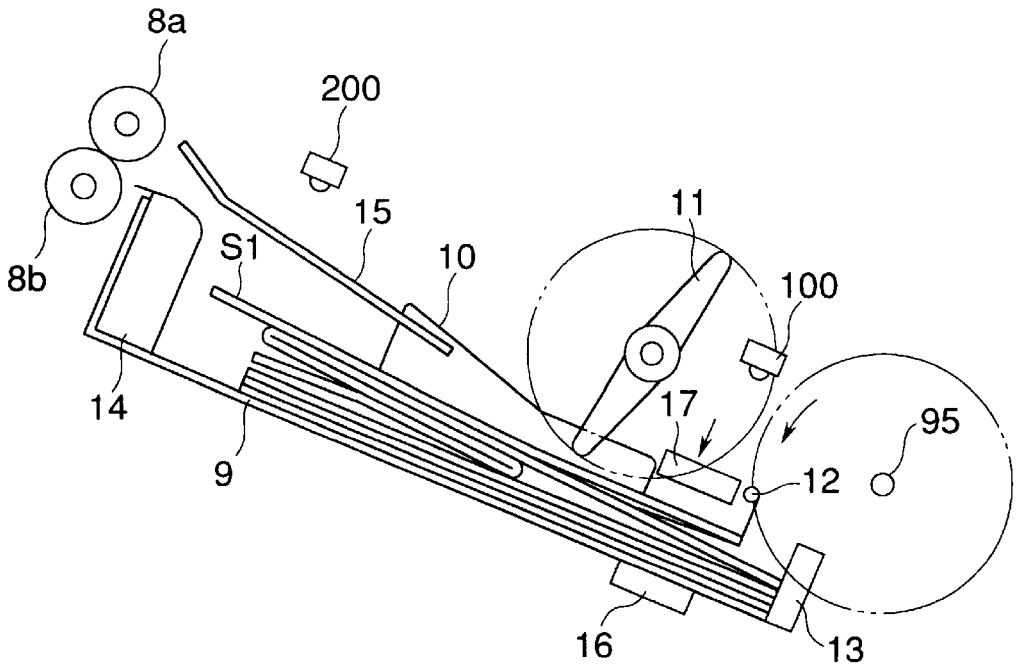
FIGS. 12C and 12D are sectional views showing a condition that the sheets are being stored.

After a predetermined number of sheets were aligned with each other, the aligned sheet bundle is started to be gripped by the movable and fixed grip plates 17, 16 of the sheet bundle conveying apparatus 203, and, at the same time, the stop finger drive motor 93 is operated to rotate the stop finger rotation support shaft 95 (supported by the stop finger support plates 81 via the bearings 82) through the stop finger drive input shaft 75, stop finger rotation input pulley 17, stop finger rotation input belt 79 and stop finger rotation drive pulley 83. The rotation of the shaft 95 causes the stop finger rotation support plates (arms) 86 (mounted on the stop finger rotation support shaft 95 via the stop finger rotation support plate bearings 85) to rotate, with the result that the stop finger shaft 91 supported by the stop finger rotation support plates 86 via the bearings 90 is revolved, thereby revolving the stop finger means 12, as shown in FIG. 12C. In this case, by the revolution of the shaft 91 and the rotation support plates 86, the stop finger phasing drive toothed belt 89 is rotated around the toothed peripheral surface of the stop finger phasing relay pulley 84 secured to the support plate 81.

As a result, the shaft 91 performs a reverse rotation (rotation in a clockwise direction) at a ratio of 1:1 with respect to the rotational angle of the stop finger rotation support plates 86. Consequently, even when the stop finger means 12 is revolved around the stop finger rotation support shaft 95, an angle between the stop finger means 12 and the stacking surface of the containing tray 9 is not varied. By the above-mentioned operations, the stop finger means 12 contacts with the upper surface of the aligned sheet bundle detected by the tip end bundle thickness detection sensor 100 at an abut position and can receive or store succeeding sheets (FIG. 12C).

Figure 12D:
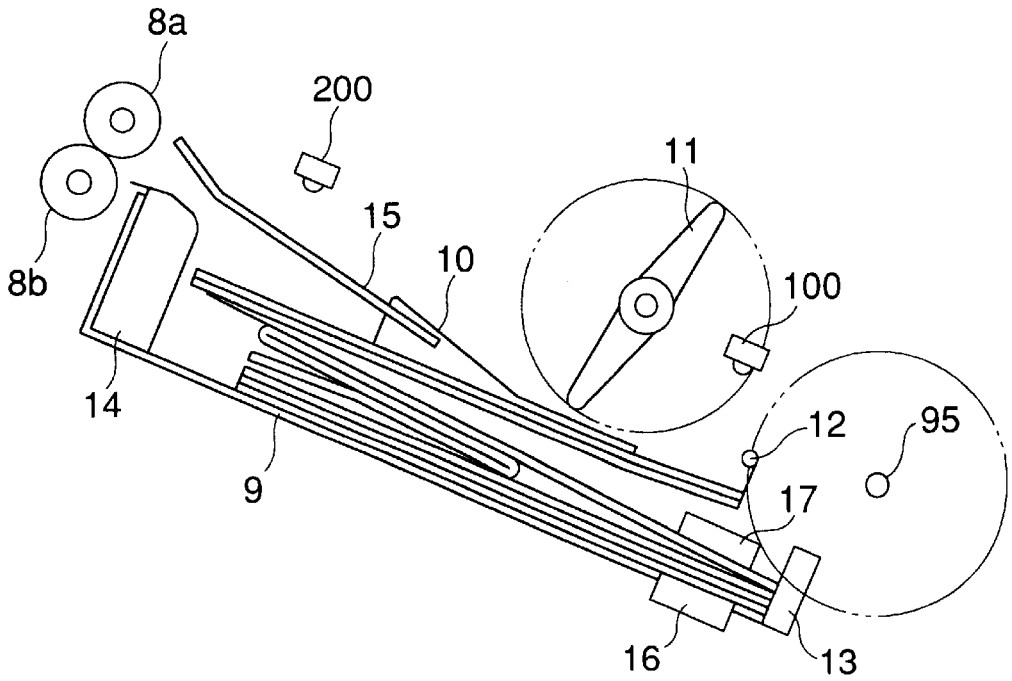

After at least one succeeding sheet is stored on the stop finger means 12, the stop finger drive motor 93 is rotated in a reverse direction so that the stop finger means 12 is retracted, by the above-mentioned mechanism, to a position (retract position) higher than a height of the trail end of the aligned sheet bundle (detected by the trail end bundle thickness detection sensor 200) by a predetermined amount, as shown in FIG. 12D. In this case, the alignment paddle 11 is also lifted by the alignment paddle lift/lower mechanism by a height amount equal to a height difference between the above-mentioned abut position and the retract position (height difference from the stacking surface of the containing tray 9).

Figure 13E:
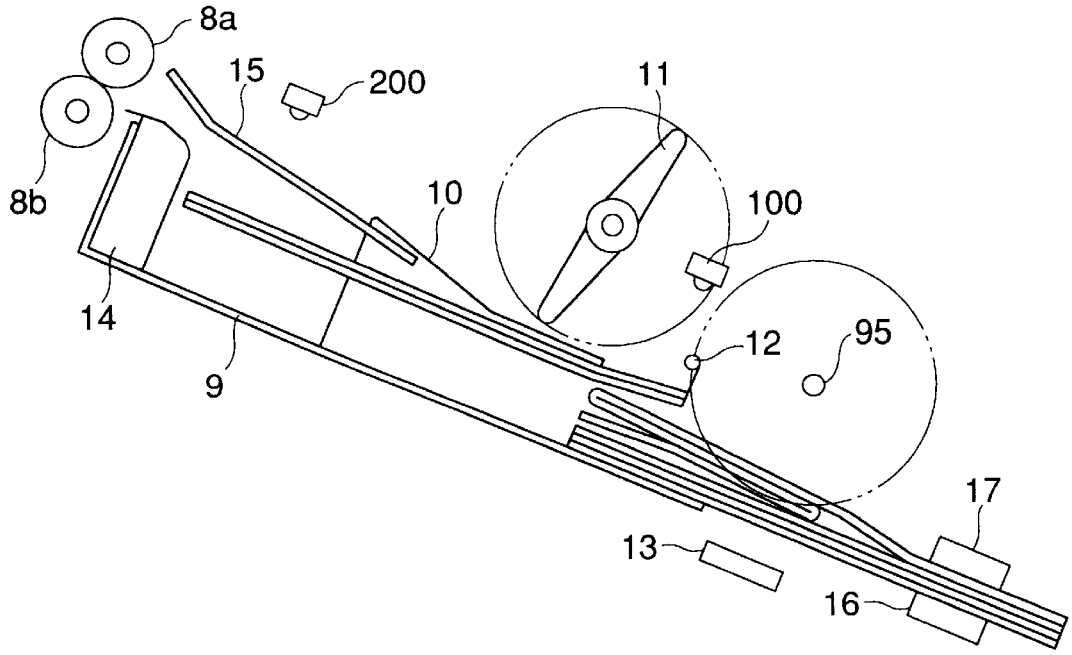
FIGS. 13E and 13F are sectional views showing a condition that a sheet bundle is being conveyed.
Figure 13F:
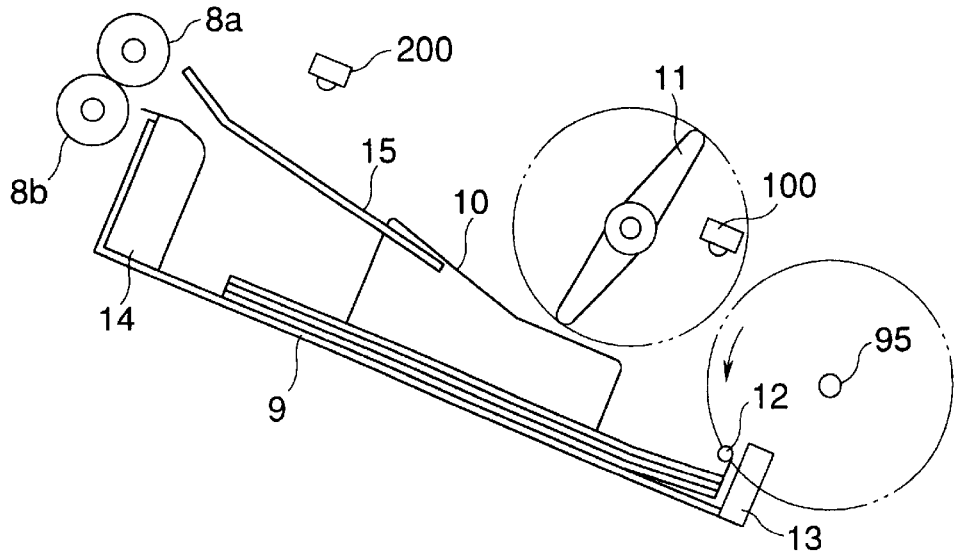

After the stop finger means 12 is retracted to the retracted position and the aligned sheet bundle is pinched between the movable and fixed grip plates 17 and 16, a drive mechanism (not shown) for driving the tip end reference shutter 13 is operated to release the tip end reference shutter 13 as shown in FIG. 13E, with the result that the aligned sheet bundle is conveyed to the tape heating apparatus 204 by the sheet bundle conveying apparatus 203.

After the aligned sheet bundle is conveyed from the sheet aligning apparatus 202 by the sheet bundle conveying apparatus 203, the drive mechanism (not shown) for driving the tip end reference shutter 13 is operated again to return the tip end reference shutter 13 to the reference position. As a result, the stop finger means 12 is revolved around the stop finger rotation support shaft 95 in a direction shown by the arrow (FIG. 13F) and is also rotated in the clockwise direction by the normal rotation of the stop finger drive motor 93 and the stop finger drive mechanism, with the result that the stored sheet bundle is urged against the tip end reference shutter 13 and is then transferred to the containing tray 9.

Figure 14G:
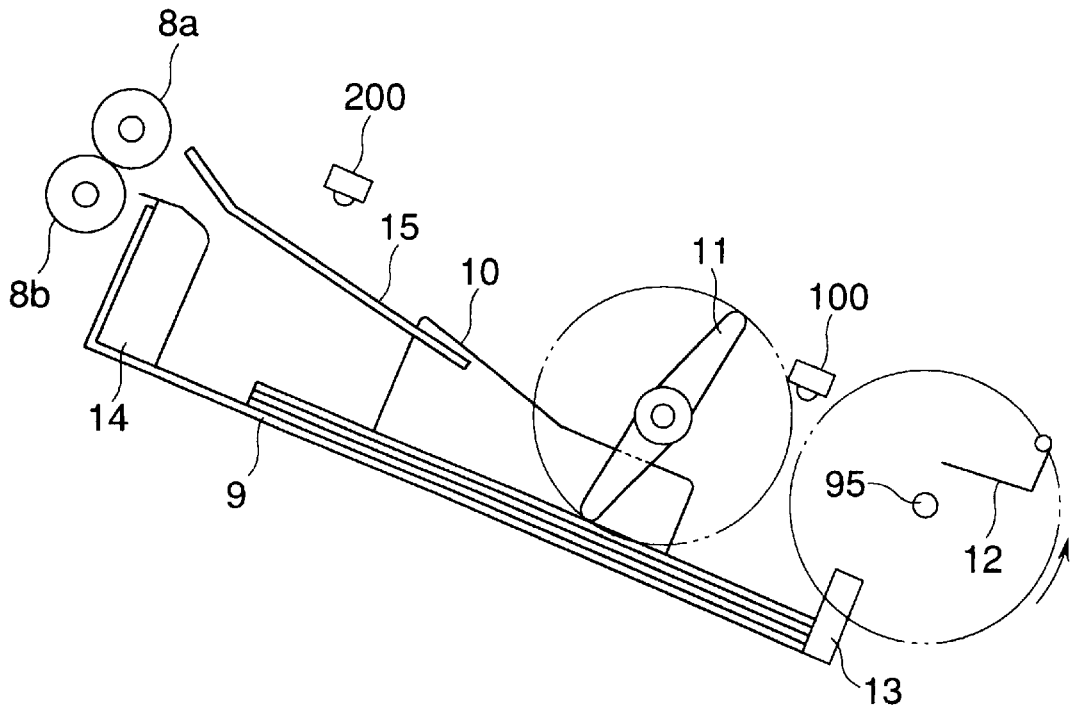
FIG. 14G is a sectional view showing a condition that the sheets are being aligned.

Even after the sheet bundle is transferred from the stop finger means 12 to the containing tray 9, the stop finger drive motor 93 continues to rotate in the normal direction (FIG. 14G), thereby returning the stop finger means 12 to the waiting position F1 (FIG. 11A). On the other hand, as shown in FIG. 14G, the alignment paddle 11 is lowered by the paddle lift/lower mechanism to the predetermined level so that the sheets conveyed onto the sheet bundle transferred to the containing tray 9 can successively be aligned.

Next, another embodiment of the present invention in which a portion of the apparatus is modified will be explained with reference to FIG. 15.

Figure 15:
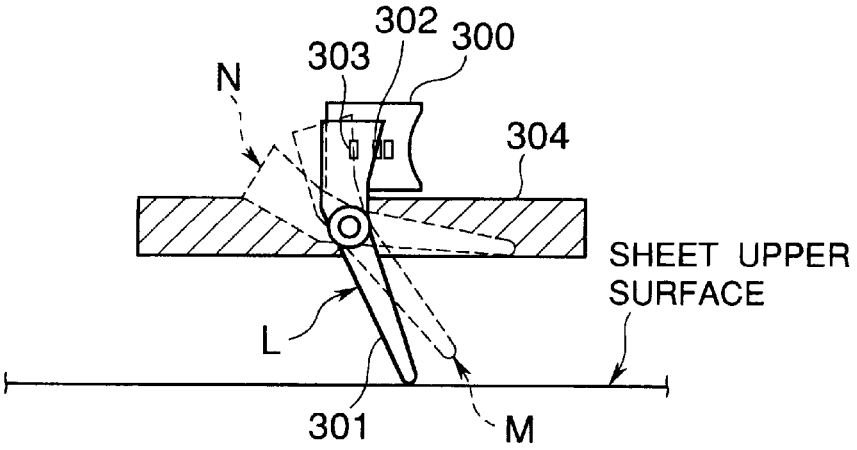
FIG. 15 is a sectional partial view showing an embodiment wherein an aligning mechanism is partially modified.

In the above-mentioned embodiment, while an example that the distance sensor is used as the tip end bundle thickness sensor was explained, as shown in FIG. 15, a multi photo-interrupter 300 may be attached to a movable grip plate 304 of the sheet bundle conveying apparatus to detect a thickness of a sheet bundle. In FIG. 15, the multi photo-interrupter 300 includes an actuator lever 301 abutting against an upper surface of the sheet, a first detection window 302, and a second detection window 303. The actuator lever can be shifted between a first detection position L and a second detection position M.

The sheet thickness detection is started by shifting the movable grip plate 304 by means of a movable grip plate drive mechanism (not shown) so that the actuator lever is moved to the position (L) where the actuator lever is contacted with the upper surface of the sheet and the light shielding condition of the first detection window 302 is released. Then, when the sheets are successively stacked until a thickness of the sheet stack exceeds a predetermined value, the light shielding condition of the second detection window 303 is released (position M), which is detected as bundle thickness information for providing a drive signal to the alignment paddle lift/lower mechanism. After the drive signal is supplied to the alignment paddle lift/lower mechanism, the movable grip plate 304 is shifted again by the movable grip plate drive mechanism (not shown) so that the actuator lever is moved to the position (L) where the actuator lever is contacted with the upper surface of the sheet and the light shielding condition of the first detection window 302 is released.

The above-mentioned operations are repeated. The number of repeated operations is detected by an encoder (not shown) provided on the movable grip plate drive mechanism. On the basis of a detection result and the average shifted amount of the grip plate, the entire thickness of the sheet stack or sheet bundle can be detected.

In this embodiment, while an example that the multi photo-interrupter 300 is attached to the movable grip plate 304 of the sheet bundle conveying apparatus 203 was explained, the present invention is not limited to such an example, but, for example, the multi photo-interrupter may be fixed to the sheet aligning apparatus. In this case, by increasing the number of detection windows, the same technical advantage as the illustrated embodiment can be achieved.

Figure 16:
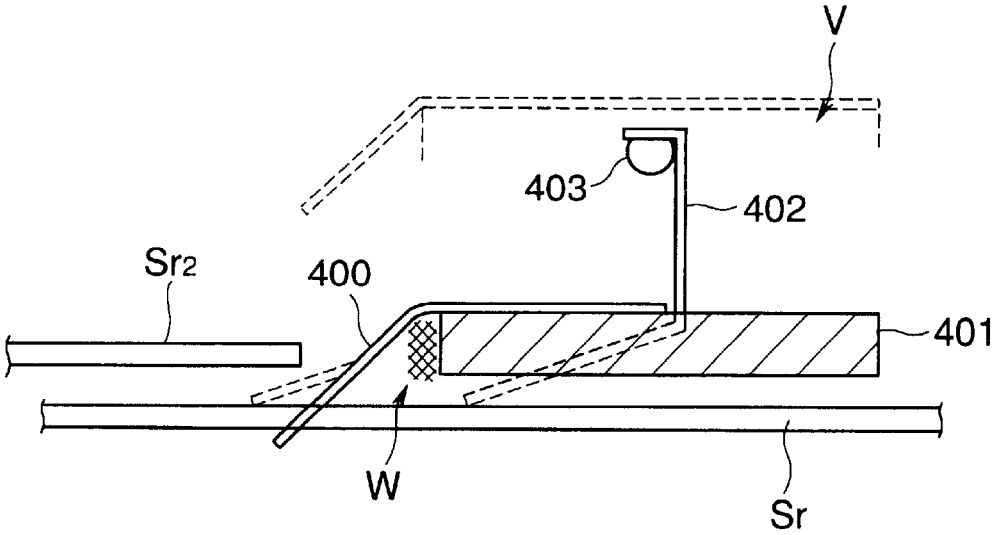
FIG. 16 is a sectional partial view showing an embodiment wherein an aligning mechanism is further partially modified.

Next, a further embodiment of the present invention in which a portion of the apparatus is further modified will be explained with reference to FIG. 16. FIG. 16 shows an example that a guide member 400 for positively guiding the stored sheets to the stop finger means 402 is provided on a movable grip plate 401 of the sheet bundle conveying apparatus.

In FIG. 16, the guide member 400 is formed from a guide Mylar sheet, and the stop finger means 402 is mounted on a stop finger shaft 403. Further, the movable grip plate 401 has a sheet entrance end surface W.

Before the movable grip plate 401 of the sheet bundle conveying apparatus is shifted to a sheet pinching or clamping position, as shown by the symbol V, the sheet Sr2 to be stored is stored on the stop finger means 402 as is in the above-mentioned embodiment. On the other hand, while the movable grip plate 401 is being shifted to the sheet pinching position, the sheet is stored on the stop finger means 402 while being guided by the guide Mylar sheet 400. Thus, the sheet can be stored on the stop finger means 402 positively without interference with the end surface W of the movable grip plate 401.

Figure 17:
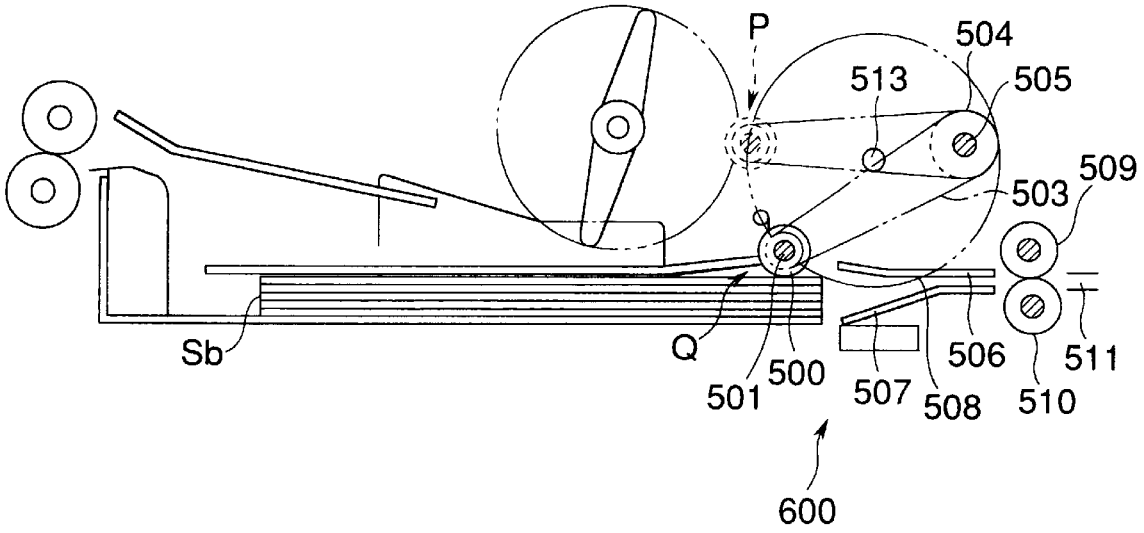
FIG. 17 is a sectional partial view showing an embodiment wherein a sheet bundle conveying mechanism is partially modified.
Figure 18A:
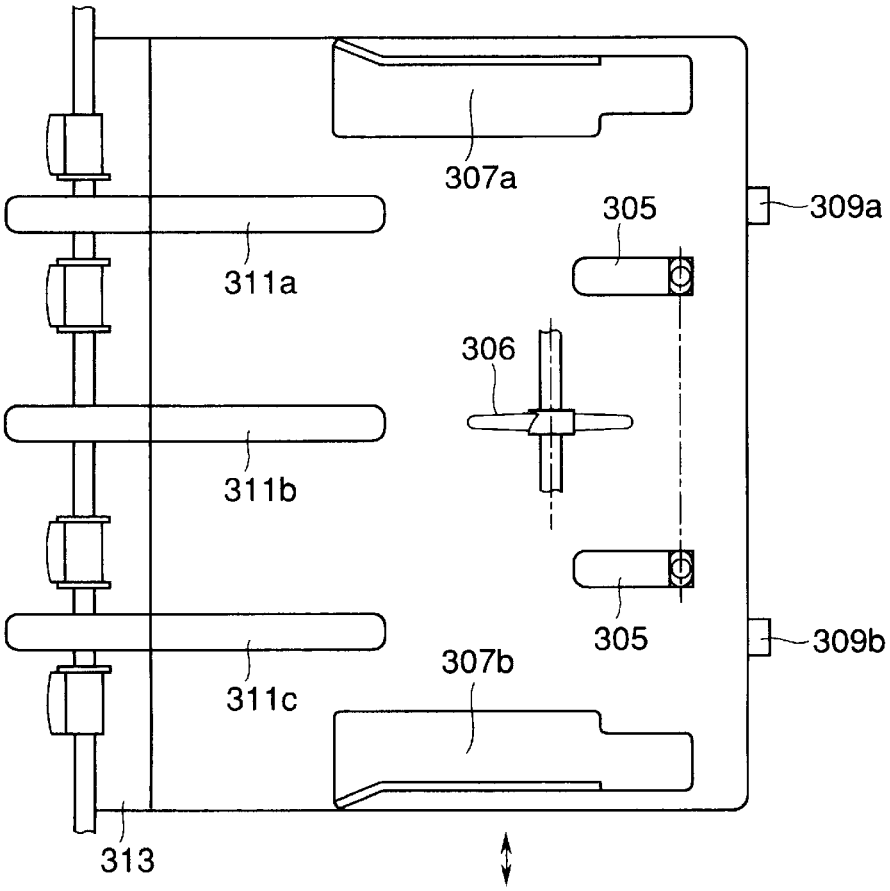
FIG.18A RELATED ART
FIGS. 18A and 18B are plan and elevational views showing a conventional sheet aligning apparatus having a sheet storing means.
Figure 18B:
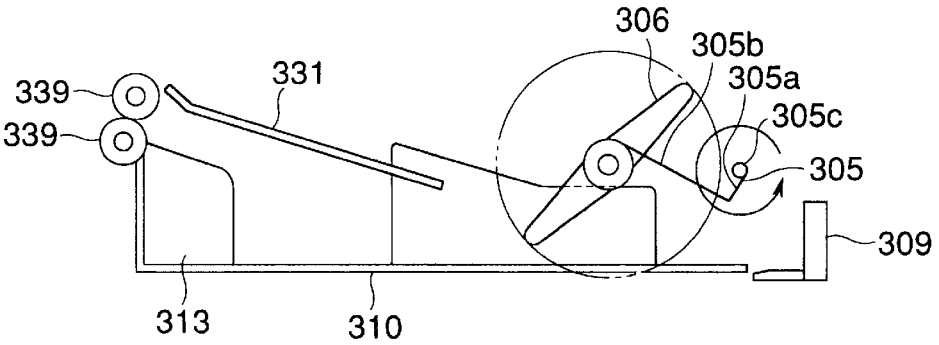

Lastly, a still further embodiment in which a single sheet conveying apparatus is used in place of the sheet bundle conveying apparatus in the aforementioned embodiment will be explained with reference to FIG. 17. In FIG. 17, the single sheet conveying apparatus 600 includes a pick-up roller 500, a pick-up roller shaft 501, a pick-up roller drive pulley 502, a pick-up roller drive belt 503, a pick-up roller drive input pulley 504, a pick-up roller drive input shaft 505, an upper convey guide 506, a lower convey guide 507, a convey path 508, an upper convey roller 509, a lower convey roller 510, a convey path 511, and a stop finger means 512. The symbol Sb denotes an aligned sheet bundle.

When a predetermined number of sheets are aligned in the sheet aligning apparatus, the pick-up roller 500 is shifted from a position P to a position Q by a shifting mechanism (not shown) and a drive motor (not shown) is operated. The driving force of the drive motor is transmitted to the pick-up roller shaft 501 through the pick-up roller drive input shaft 505, pick-up roller drive input pulley 504, pick-up roller drive belt 503 and pick-up roller drive pulley 502, with the result that the pick-up roller 500 attached to the pick-up roller shaft 501 is rotated, thereby conveying a single sheet.

The conveyed sheet passes through the convey path 508 defined between the upper and lower convey guides 506, 507 and then is introduced into the convey path 511 by the convey rollers 509, 510.

After all of the sheets of the aligned sheet bundle Sb were conveyed one by one, the pick-up roller 500 is shifted from the position Q to the position P by the shifting mechanism (not shown) to provide a waiting condition.

When the combination of the sheet aligning apparatus and the single sheet conveying apparatus is applied to a both-face sheet aligning apparatus and a both-face sheet supplying apparatus of an image forming apparatus such as a copying machine, a printer and the like, the productivity in the both-face image formation can be enhanced.

Incidentally, in the aforementioned embodiment, while an example that the bookbinding means is positioned in a spaced relation to the containing tray 9 was explained, the bookbinding means may be provided on the containing tray. Further, while an example that the sheets are aligned with each other by the alignment paddle, the sheets may be aligned by abutting the sheets against a tip end reference shutter by their own weights. In addition, while an example that the aligned sheet convey means 16, 17 for conveying the sheet bundle to the bookbinding apparatus and the drive means 31 for conveying the book-bound sheet bundle to the containing stacker are used was explained, the sheet bundle may be dropped onto the bookbinding means or the containing stacker by the weight of the sheet bundle itself.

What is claimed is:

1. A sheet stacking apparatus, comprising:

a containing tray for containing sheets;

a sheet storing means disposed above a sheet bundle contained in said containing tray and revolved between a first position to store the sheets in said sheet storing means, and a second position to shift the stored sheets to said containing tray; and a posture maintaining means for rotating said sheet storing means when said sheet storing means is revolved, so that a posture of said sheet storing means in said first position becomes substantially the same as that in said second position.

2. A sheet stacking apparatus according to claim 1, further comprising an end abutment member disposed at an end portion of said containing tray, and movable between an abutment position where an end edge of the sheets abuts against said abutment member to be aligned with each other and a retract position where said abutment member does not interfere with a feeding-out of the sheets from said containing tray.

3. A sheet stacking apparatus according to claim 2, further comprising a sheet aligning means for abutting the sheets on said containing tray against said abutment member positioned at said abutment position to align them.

4. A sheet stacking apparatus according to claim 3, wherein said sheet aligning means is a rotating paddle means.

5. A sheet stacking apparatus according to claim 2, further comprising a sheet feed-out means for feeding out the sheets aligned on said containing tray from said tip end portion of said containing tray, in a condition that said abutment member is retracted to said retract position.

6. A sheet stacking apparatus according to claim 5, wherein, after at least one sheet is received by said sheet storing means at said first position, said sheet storing means is slightly lifted and then the sheet is fed-out by said sheet feed-out means.

7. A sheet stacking apparatus according to claim 6, further comprising a detection means for detecting a thickness of the sheet bundle contained on said containing tray, and, on the basis of information from said detection means, a lift distance of said sheet storing means is set so that an end of the sheet bundle near said sheet storing means becomes higher than a trail end of the sheet bundle.

8. A sheet stacking apparatus according to claim 1, wherein said posture maintaining means comprises a rotation support plate revolving and rotatably supporting said sheet storing means, and a phasing drive pulley for rotating said sheet storing means in order to maintain the posture of said sheet storing means substantially constant.

9. A sheet stacking apparatus according to claim 8, wherein said drive pulley is a toothed pulley which is secured to a shaft supporting said rotation support plate for revolving movement, and which is connected to a toothed pulley secured to a rotation shaft of said sheet storing means through a toothed belt.

10. A sheet stacking apparatus according to claim 1, wherein said sheet storing means has a substantially L-shaped configuration to store an end portion of each of the sheets on a bottom surface thereof to distinguish the sheets from the sheet bundle on said containing tray.

11. A sheet stacking apparatus according to claim 1, wherein after said sheet storing means receives at least one sheet at said first position, it is slightly lifted so that one end of the sheet nearer to said sheet storing means becomes higher than an other end of the sheet more remote from the one end.

12. A sheet stacking apparatus according to claim 1, wherein, after the sheet bundle drawn out from said containing tray, said sheet storing means is shifted to said second position.

13. A sheet stacking apparatus according to claim 1, further comprising a sheet thickness information means provided on said containing tray, and said first position is set on the basis of information from said information means.

14. A sheet stacking apparatus according to claim 1, further comprising a supply means for separating and supplying the sheets in the sheet bundle on said containing tray one by one.

15. A sheet stacking apparatus, comprising:

a containing tray for containing sheets;

a sheet storing means disposed above a sheet bundle contained in said containing tray and movable between a first position to store the sheets in said sheet storing means, and a second position to shift the stored sheets to said containing tray; and a posture maintaining means for shifting said sheet storing means when said sheet storing means is moved, so that a posture of said sheet storing means in said first position becomes substantially the same as that in said second position.

16. A sheet stacking apparatus, comprising:

a containing tray for containing sheets;

a sheet feed-out means for feeding out the sheets on said containing means;

a sheet storing means disposed above a sheet bundle contained in said containing tray and movable between a first position to store the sheets in said sheet storing means, and a second position to shift the stored sheets to said containing tray; and a posture maintaining means for shifting said sheet storing means when said sheet storing means is moved, so that a posture of said sheet storing means in said first position becomes substantially the same as that in said second position, wherein after said sheet storing means receives at least one sheet at said first position, it is slightly lifted and then the sheet is fed-out by said sheet feed-out means.

17. A sheet aligning apparatus, comprising:

a containing tray for containing sheets;

a sheet storing means disposed above a sheet bundle contained in said containing tray and movable between a first position to store the sheets in said sheet storing means, and a second position to shift the stored sheets to said containing tray; and a posture maintaining means for shifting said sheet storing means when said sheet storing means is moved, so that a posture of said sheet storing means in said first position becomes substantially the same as that in said second position, wherein after said sheet storing means receives at least one sheet at said first position, it is slightly lifted so that a tip end of the sheet becomes higher than a trail end of the sheet.

18. A sheet stacking apparatus, comprising:

a containing tray for containing sheets;

a sheet thickness information means provided on said containing tray;

a sheet storing means disposed above a sheet bundle contained in said containing tray and movable between a first position to store the sheets in said sheet storing means and a second position to shift the stored sheets to said containing tray; and a posture maintaining means for shifting said sheet storing means when said sheet storing means is moved, so that a posture of said sheet storing means in said first position becomes substantially the same as that in said second position, wherein said first position is set on the basis of information from said information means.

19. A bookbinding apparatus, comprising:

a containing tray for containing sheets;

a sheet storing means disposed above a sheet bundle contained in said containing tray and revolved between a first position to store the sheets in said sheet storing means, and a second position to shift the stored sheets onto said containing tray;

a posture maintaining means for rotating said sheet storing means when said sheet storing means is revolved, so that a posture of said sheet storing means in said first position becomes substantially the same as that in said second position;

a binding means for binding the sheet bundle; and transport means for transporting the sheet bundle contained in said containing tray to said binding means.

20. A bookbinding apparatus according to claim 19, further comprising a stacker means for stacking the bound sheet bundles.

21. An image forming apparatus, comprising:

an image forming means;

a containing tray for containing sheets on which images have been formed;

a sheet storing means disposed above a sheet bundle contained in said containing tray and revolved between a first position to store the sheets in said sheet storing means, and a second position to shift the stored sheets onto said containing tray;

a posture maintaining means for rotating said sheet storing means when said sheet storing means is revolved, so that a posture of said sheet storing means in said first position becomes substantially the same as that in said second position; and supply means for separating and supplying the sheets in the sheet bundle contained in said containing tray one by one.

22. A sheet stacking apparatus according to claim 10, wherein said sheet containing tray is inclined so that an upstream side thereof becomes higher than a downstream side thereof to allow a sheet feeding from the upstream side, and said sheet storing means is disposed downstream of said containing tray.

23. A sheet stacking apparatus according to claim 22, further comprising a press means for pressing a tip end of the sheet being fed against a wall of said storing means.

24. A sheet stacking apparatus according to claim 23, wherein an end abutment member for aligning the tip end of the sheet is disposed downstream of said containing tray, said end abutment member being shifted to a retract position upon completion of containing the sheet, and said L-shaped storing means revolves for causing an edge of the sheet bundle to abut against said end abutment member during the revolution thereof, to thereby retain the sheet bundle on said containing tray.

* * * * *

UNITED STATES PATENT AND TRADEMARK OFFICE

CERTIFICATE OF CORRECTION

PATENT NO. : 5,992,839

DATED : November 30, 1999

INVENTOR(S) : Hideaki KOSASA

It is certified that error appears in the above-identified patent and that said Letters Patent is hereby corrected as shown below:

COLUMN 1:

Line 14, "are" should read --were--.
Line 15, "is" should read --was--.

COLUMN 2:

Line 32, "the poor" should read --poor--.

COLUMN 3:

Line 45, "align ed" should read --aligned--.

UNITED STATES PATENT AND TRADEMARK OFFICE

CERTIFICATE OF CORRECTION

PATENT NO. : 5,992,839

DATED : November 30, 1999

INVENTOR(S) : Hideaki KOSASA

It is certified that error appears in the above-identified patent and that said Letters Patent is hereby corrected as shown below:

COLUMN 4:

Line 57, "aligning" should read --aligning apparatus--.
Line 64, "which a" should read --in which the--.

COLUMN 5:

Line 24, "abuts" should read --and abuts--.
Line 64, "16)." should read --16.)--.

COLUMN 6:

Line 22, "was," should read --is--.

COLUMN 7:

Line 15, "temporarily" should read --temporary--.
Line 41, "which" should be deleted.
Line 50, "extending" should read --extends--.
Line 55, "temporarily" should read --temporary--.
Line 61, "puddle" should read --paddle--.

COLUMN 8:

Line 4, "is contained" should read --contained--.

UNITED STATES PATENT AND TRADEMARK OFFICE

CERTIFICATE OF CORRECTION

PATENT NO. : 5,992,839

DATED : November 30, 1999

INVENTOR(S) : Hideaki KOSASA

It is certified that error appears in the above-identified patent and that said Letters Patent is hereby corrected as shown below:

COLUMN 8:

Line 13, "rotate" should read --to rotate--.

COLUMN 10:

Line 61, "were" should read --are--.

COLUMN 12:

Line 18, "an other" should read --another--.
Line 21, "drawn" should read --is drawn--.
Line 61, "fed-out" should read --fed out--.

Signed and Sealed this

Fourteenth Day of November, 2000

*Attest:*

Q. TODD DICKINSON

*Attesting Officer*

*Director of Patents and Trademarks*